US007494579B2

(12) United States Patent
Robinson et al.

(10) Patent No.: US 7,494,579 B2
(45) Date of Patent: Feb. 24, 2009

(54) SPOUTED BED ELECTRODE CELL FOR METAL ELECTROWINNING

(75) Inventors: Douglas J. Robinson, Phoenix, AZ (US); Stacey A. MacDonald, Phoenix, AZ (US); Vladimir Jiricny, Suchdol (CZ); Dario Oldani, Milan (IT); Francesco Todaro, Milan (IT); Leonello Carrettin, Milan (IT); Gian Nicola Martelli, Milan (IT); Davide Scotti, Balsamo (IT)

(73) Assignee: De Nora Elettrodi S.p.A., Milan (IT)

( * ) Notice: Subject to any disclaimer, the term of this patent is extended or adjusted under 35 U.S.C. 154(b) by 731 days.

(21) Appl. No.: 10/520,955

(22) PCT Filed: Jul. 11, 2003

(86) PCT No.: PCT/EP03/07541

§ 371 (c)(1),
(2), (4) Date: Feb. 11, 2005

(87) PCT Pub. No.: WO2004/007805

PCT Pub. Date: Jan. 22, 2004

(65) Prior Publication Data

US 2006/0124452 A1 Jun. 15, 2006

(30) Foreign Application Priority Data

Jul. 11, 2002 (IT) ..... MI2002A1524

(51) Int. Cl.

| | |
|---|---|
| ***C25C 7/00*** | (2006.01) |
| ***C25C 1/08*** | (2006.01) |
| ***C25C 1/10*** | (2006.01) |
| ***C25C 1/12*** | (2006.01) |
| ***C25C 1/14*** | (2006.01) |
| ***C25C 1/16*** | (2006.01) |

(52) U.S. Cl. ..... 205/348; 205/572; 205/573; 205/574; 205/594; 205/587; 205/602; 205/610; 204/257; 204/261

(58) Field of Classification Search ..... None
See application file for complete search history.

(56) References Cited

U.S. PATENT DOCUMENTS

| | | | | |
|---|---|---|---|---|
| 3,974,049 | A | 8/1976 | James et al. | |
| 4,019,968 | A | 4/1977 | Spaziante et al. | |
| 4,425,214 | A * | 1/1984 | Pellegri | 204/254 |

(Continued)

FOREIGN PATENT DOCUMENTS

| | | |
|---|---|---|
| WO | WO 01/40549 A1 * | 6/2001 |

(Continued)

OTHER PUBLICATIONS

A study of the spouted-bed electrowinning of copper V. Jiricny The Minerals, Metals & Materials Society, 1999.

(Continued)

*Primary Examiner*—Harry D Wilkins, III
(74) *Attorney, Agent, or Firm*—Charles A. Muserlian

(57) ABSTRACT

It is herein described an electrowinning cell with a spouted bed electrode of growing metallic beads, separated by a semi-permeable diaphragm and suitable for being assembled in a stack in a modular arrangement.

48 Claims, 10 Drawing Sheets

U.S. PATENT DOCUMENTS

| | | | | |
|---|---|---|---|---|
| 6,241,220 | B1 * | 6/2001 | Blackwell et al. | 261/38 |
| 6,936,142 | B2 * | 8/2005 | Hradil et al. | 204/222 |
| 6,984,296 | B1 * | 1/2006 | Gestermann | 204/252 |

FOREIGN PATENT DOCUMENTS

| | | |
|---|---|---|
| WO | WO 02/053809 | 7/2002 |

OTHER PUBLICATIONS

Spouted Bed Electrowinning of Zinc: Part I vol. 28B Feb. 1997 Juan Carlos Salas-Morales Metallurgical & Material Transactions.

Spouted Bed Electrowinning of Zinc: Part II A. Verma Metallurgical & Material Transactions vol. 28B Feb. 1997.

* cited by examiner

SPOUTED BED ELECTRODE CELL FOR METAL ELECTROWINNING

This application is a 371 of PCT/EP2003/007541 filed Jul. 11, 2003.

BACKGROUND OF THE INVENTION

The recovery of metals from moving bed cells is known in the art as a very attractive technique, albeit still far from actual industrial practice. Moving bed metal deposition has been first described as an improvement of the more general concept of fluidised bed metal deposition (see for instance U.S. Pat. No. 4,141,804) by Scott et al. in U.S. Pat. No. 4,272,333. A bed of metallic beads is levitated by a liquid electrolyte jet until it passes the top edge of a metal cathode, overflowing in a chamber delimited by such cathode and a semi-permeable diaphragm, separating the falling bed from the anode. The falling bed is thus cathodically polarised, and the metal ions in the electrolyte can discharge on the beads causing their growth. The disclosed method allows to feed the beads as small seeds and to discharge them from the cell after reaching the required growth, but has the obvious drawback of being substantially a batch procedure. Moreover, the cell must be operated as a single cell and has no possibility of being effectively stacked in a laminar arrangement, and its productive capacity by unit volume or by unit installation surface is therefore very limited.

A significant improvement of this concept is offered by the disclosure of U.S. Pat. Nos. 5,635,051 and 5,958,210, directed to the electrowinning of zinc. In this case, the cathodic compartment contains a spouted bed generated by the ascending motion of the electrolyte supplied to a draft tube, and split in two annuli in the falling regions, disposed at the two sides of the tube. The cathodic and anodic compartments are separated by means of an ion-permeable barrier, such as an ion-exchange membrane or the like. The anolyte and the catholyte are therefore physically separated and the growing beads are again excluded from the anodic compartment, but the passage of the ion to be deposited from the anodic to the cathodic compartment is allowed. The cell is somehow better than the one disclosed in U.S. Pat. No. 4,272,333 in terms of productive capacity, being quite flat, and even foreseeing the possibility of a parallel arrangement of a plurality of draft tubes and relevant falling bead annuli to increase the size of at least one dimension thereof. Nevertheless, the deposition disclosed therein is still a typical batch process, the depletion of metal ions in the anolyte chamber having to be counteracted with a delicate restoring procedure, in order to maintain a certain stability of the cell conditions.

It is an object of the present invention to provide a spouted bed cell for the recovery of metal from metal solutions overcoming the drawbacks of the prior art.

Under a different aspect, it is an object of the present invention to provide a method for electrowinning metal from a metal ion bearing electrolyte overcoming the drawbacks of the prior art.

SUMMARY OF THE INVENTION

Under a first aspect, the invention consists in a spouted bed electrowinning cell element that can be laminated in an array of equivalent elements in a modular fashion.

Under another aspect, the invention consists in a spouted bed electrowinning cell element comprising a cathode shell delimited by a cathodic plate and provided with a draft tube capable of establishing a spouted bed of growing metallic beads, an anodic plate provided with protrusions for mechanically holding a metal anode and transmitting electric current thereto, and one insulating semi-permeable diaphragm separating the cathodic and the anodic compartments which allows the free passage of the electrolyte while hindering the passage of the metallic beads.

Under still another aspect, the invention consists in an array of stacked electrowinning spouted bed cell elements, each delimited by an anodic plate and a cathodic plate, each anodic plate put in contact with the cathodic plate of the adjacent cell, preferably by means of contact strips.

Under still another aspect, the invention consists in a method for electrowinning metals from metal solutions by controlled growth of spouted metal beads, carried out in an array of modular cell elements wherein the electrolyte is allowed to circulate freely between the anodic and the cathodic compartment upon flowing through an insulating semi-permeable diaphragm. These and other aspects will be made apparent from the following description.

DETAILED DESCRIPTION OF THE INVENTION

The invention will be described making reference to the appended exemplary drawings, however it is not intended to be limited thereto.

The cell of the invention is designed to act preferably as an element of a laminated array of equivalent cells, even though it can also be used as a single cell for metal electrowinning.

The cell of the invention is suited to carry out the electrowinning of many different metals, including, but not limited to, copper, tin, manganese, zinc, nickel, chromium and cobalt.

Figure 1:
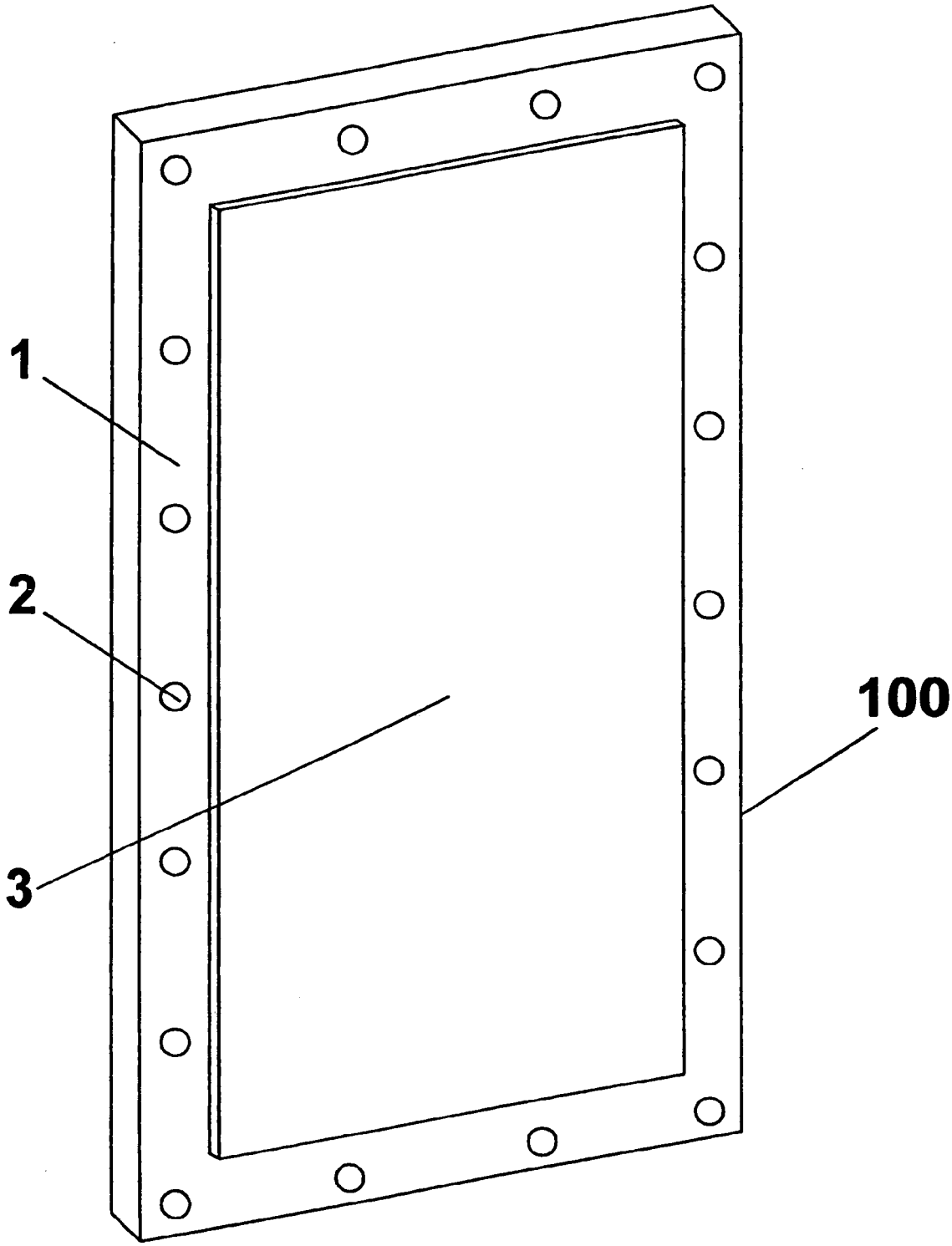
FIG. 1 is a back view of the cathode shell of a spouted bed electrowinning cell according to a preferred embodiment of the invention.

The cell element of the invention comprises a cathode shell and an anode shell, each delimited by a metallic plate. The anodic metallic plate of the cell is suited to be electrically coupled in a straightforward fashion to the cathodic plate of the adjacent cell in the laminated array; in a preferred embodiment, this electrical coupling is effected by clamping together a plurality of single cell elements in a stack, so that each single cell element can be removed and/or replaced at any time, for instance for maintenance purposes, upon releasing the clamping pressure and extracting the same. The cathode shell is preferably made of stainless steel, but for many applications other materials are suitable, such as nickel or titanium. In a preferred embodiment, the cathode shell is made of an array of rectangular stainless steel bars with a cathodic plate welded thereon. Making reference to FIG. 1, the back side of a cathode shell (100) provided with bolt holes (2) in the flange or more generally in the frame-shaped peripheral region thereof (1) is shown; a cathodic plate (3), preferably of the same material of the peripheral frame (1), is secured thereto. In a preferred embodiment, the bars forming the peripheral frame (1) are mutually welded at the corners, and the cathodic plate (3) is then welded to the peripheral frame (1). For single cell operation, it may be useful to provide the cathode shell (100) with a transparent window portion (not shown) to monitor the behaviour of the spouted bed. This may also be a useful feature for the terminal cells of a cell array. The coupling of the cathodic plate (3) with the peripheral frame (1) defines a recessed portion on the other (front) side of the cathode shell (100), whose detailed features will be discussed later on.

Figure 2:
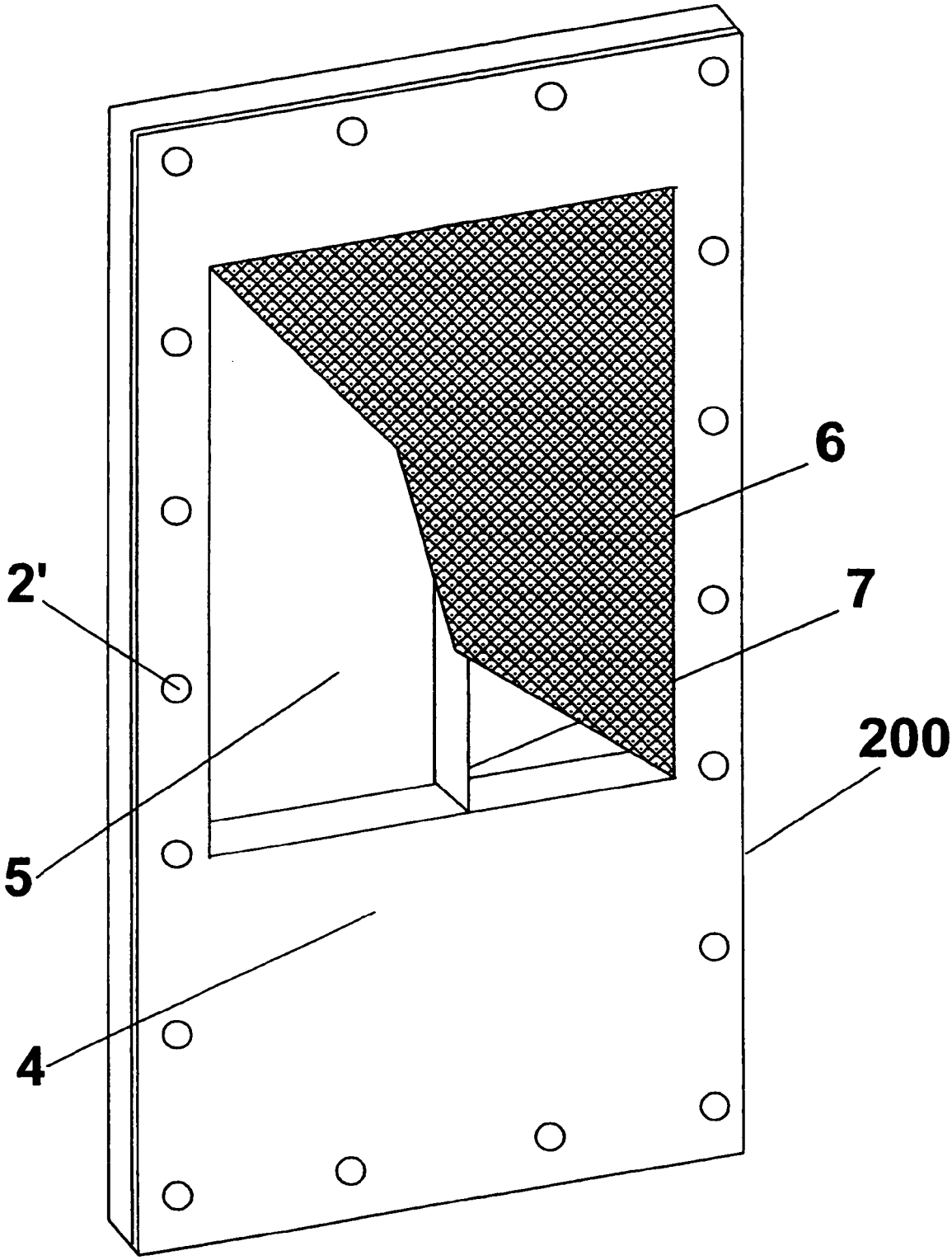
FIG. 2 and FIG. 3 are respectively the front and the back view of the anode shell of a spouted bed electrowinning cell according to a preferred embodiment of the invention.

The anodic plate is preferably fabricated from a metal sheet; valve metals are normally used for this purpose, to withstand the aggressive conditions of the anodic environment, and titanium or titanium alloys are particularly preferred, also for considerations of cost and workability. As shown in FIG. 2, the anodic sheet (4) forming the main body of the anode shell (200) is also provided with bolt holes (2'), which are used in connection with the bolt holes (2) of the cathode shell (100) to clamp the two shells together. The anode shell (200) has also a recessed portion (5) generally corresponding to the falling region of the spouted bed where metal deposition on the growing beads occurs, as will be discussed in detail later on. An anode (cutaway shown as (6)) is mounted in correspondence of the recessed portion (5); the connection of the anode (6) to the anodic plate ((9) in FIG. 3) is effected by means of conducting protrusions (7). Since in metal electrowinning processes the anodic reaction is in most of the cases oxygen evolution, the anode (6) will be preferably provided with a catalytic coating for oxygen evolution, as known in the art. The anode may be for instance a foraminous titanium structure, such as a punched or expanded sheet or a mesh, provided with a noble metal or noble metal oxide coating. Only one protrusion (7) has been shown in FIG. 2, yet it is apparent to one skilled in the art that a plurality of protrusions (7) is usually more useful. At least one of the protrusions (7) must be electrically conducting to ensure the electrical continuity between the anodic plate and the anode (6), but other types of protrusions can act just as spacers and be constructed of non conductive material such as plastics. In FIG. 2, the conductive protrusion (7) is shaped as a rib, according to a particularly preferred embodiment; it will be apparent to one skilled in the art that other types of geometry can as well be suited to such protrusions.

Figure 3:
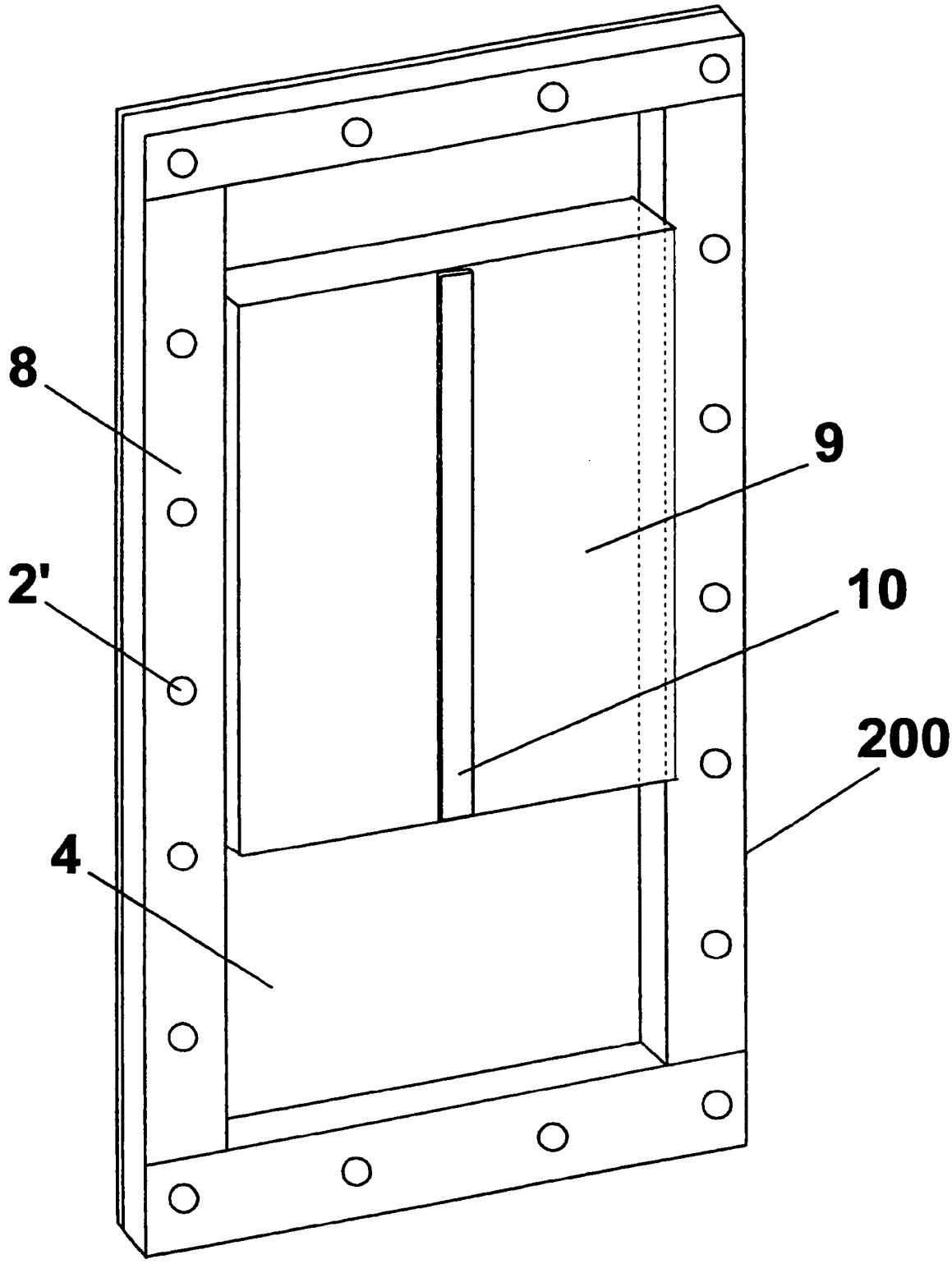

The preferred configuration for the anode shell (200) will be made clearer with the sketch of its back view in FIG. 3. As shown there, the anodic sheet (4) that forms the main body of the anode shell (200) is preferably provided with a reinforcement frame (8) also acting as a flange, wherein the bolt holes (2') thereof are prolonged. In a preferred embodiment, the anodic plate (9) is welded to the reinforcement frame (8); subsequently, the conductive protrusions ((7) in FIG. 2) are welded to the front side of the anodic sheet (4). In the embodiment of FIG. 3, a contact strip (10) is shown, secured to the back side of the anodic plate; it is however apparent to one skilled in the art that in most of the cases, a plurality of contact strips (10) will be used, depending on the cell dimensions and to the total electric current flow required by the process. Here the contact strip (10) is shown as secured to the anodic plate (9), but it might as well be secured to the cathodic plate (3) or both, although this is a less preferred embodiment. In a preferred embodiment, contact strips (10) are bimetallic elements, with a titanium face welded to the titanium anodic plate (9), and a copper, nickel or silver face providing for an improved electrical contact with the cathodic plate (3). In a preferred embodiment, the conductive protrusions (7), the anodic plate (9), and the portion of the contact strip (10) facing the anodic plate (9) are made of the same material, for instance titanium or an alloy thereof, and are welded together in a single pass, for instance by laser welding. Contact strips (10) could advantageously be interposed also between the conductive protrusions (7) and the anodic plate (9).

The two shells (100) and (200) are first bolted or otherwise clamped together to form a single cell element, then the single cell elements are laminated in a stack array at a sufficient pressure so that the contact strips (10) can effectively transmit the electric current from the anodic compartment to the cathodic plate (3) of the adjacent cell; when contact strips (10) are not used, direct contact may be effected from the cathodic plate (3) to the anodic one (9), this being however a less preferred solution since the contact surface would be larger, thereby requiring a greater clamping force to apply the same pressure; moreover, if titanium or other valve metals are used for the anodic plate (9), the electric contact would be eventually spoiled in time due to oxide growth.

Metal electrowinning cells can be either of the divided or of the undivided type, according to the different technologies; in the cells of the divided type, such as those in accordance with the disclosure of U.S. Pat. Nos. 5,635,051 and 5,958,210, it would be more cumbersome to achieve a continuous type process. In the best mode for carrying out the invention, the cell is an undivided cell, in that there are no separate anolyte and catholyte, but rather a single electrolyte flowing from one compartment to the other. However, a mechanical separator is needed to exclude the cathodically polarised growing beads from the anodic compartment. This is achieved by means of a semi-permeable diaphragm, as illustrated in FIG. 4.

Figure 4:
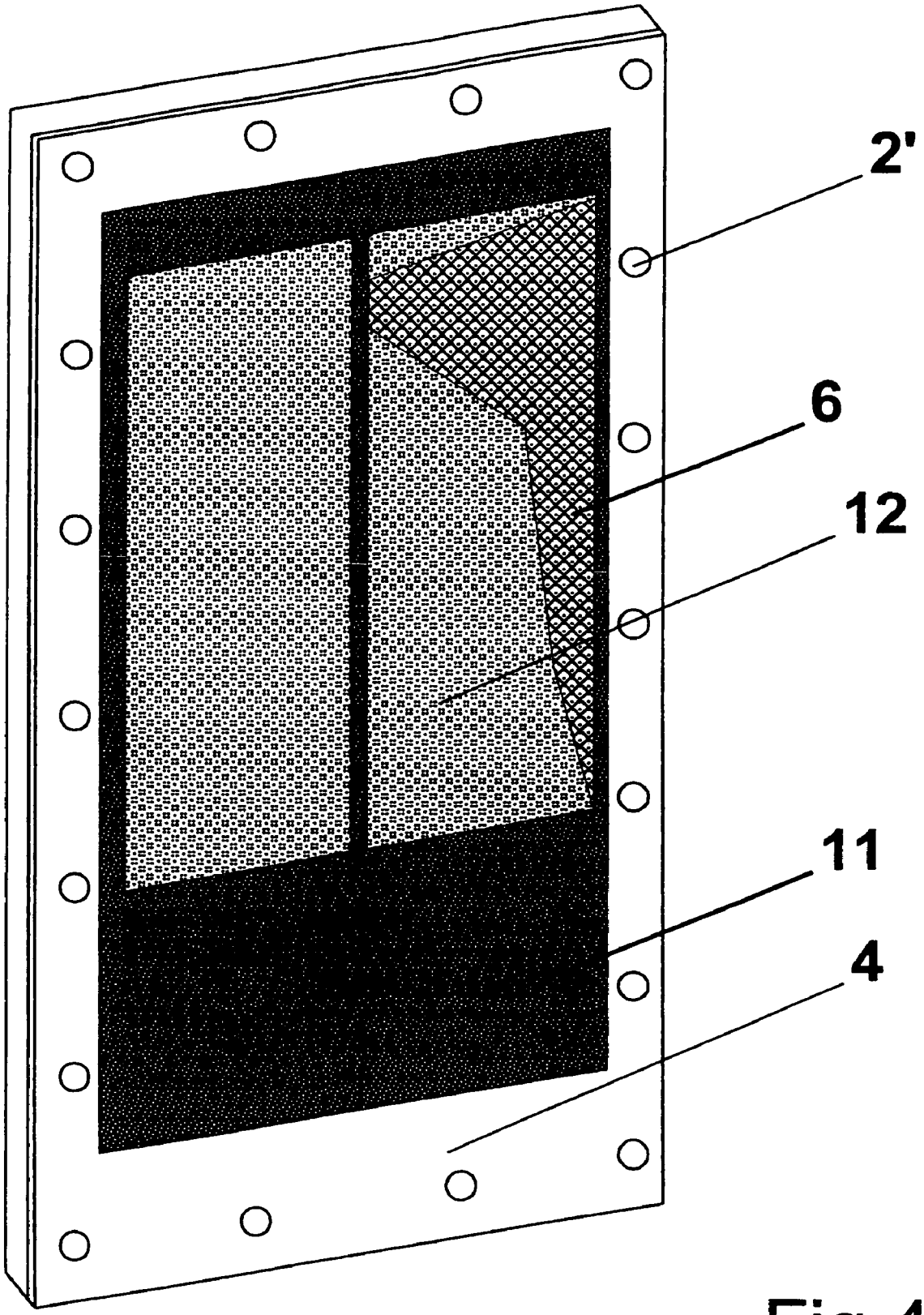
FIG. 4 is the same front view of the anode shell as in FIG. 2, further including an insulating full face diaphragm according to one embodiment of the invention.

FIG. 4 shows the overlapping of a diaphragm (11) to the anode compartment of FIG. 2. The diaphragm (11) is shown here as a full face gasket, contributing to the external peripheral sealing, this feature nevertheless being not compulsory. Its edges are shown as internal to the bolt holes (2'), but it can as well be larger and have matching perforations for the bolts. One of the essential features of the diaphragm (11) is that it must be electrically insulating, as it is in contact with both the anode (6) and the cathodically charged metal beads. Another essential feature of the diaphragm (11) is that it must be provided with at least one porous or foraminous region (12) allowing for the circulation of the electrolyte, generally in correspondence with the anode recessed portion (5) and thus with the deposition region of the spouted bed. The perforations of this region must be sufficiently narrow to exclude even the smallest beads of the spouted bed, so typically they are dimensioned as smaller than the tiny metal seeds fed in the cell as the starting material. The diaphragm can as well be completely foraminous or porous, and have no gasketing function at all. The perforated region (12) of the diaphragm (11) is the true characterising part thereof: many insulating materials have been tested for the diaphragm, but only few are effectively working, especially due to the fact that the column of metal beads of the spouted bed, which in some cases can be higher than one metre, exerts a heavy load on the diaphragm, thereby resulting in a heavy friction.

In a preferred embodiment, the insulating diaphragm is simply obtained by applying an insulating coating to the surface of the anode (6) facing the spouted bed, while the anodic reaction takes place on the opposed surface. In this case, the anode (6) must be a foraminous structure with suitable perforations to exclude the beads from entering the anode shell (200) while allowing the free circulation of the electrolyte. The insulating coating is preferably a ceramic coating, such as a valve metal oxide (titanium or zirconium oxides being preferred) or silicon carbide. Plasma sprayed ceramic coatings are particularly preferred. According to an alternative embodiment, the insulating coating may be a polymeric coating, preferably obtained from a fluorinated polymer such as PTFE or ECTFE (Ethylene-chlorotrifluoro-ethylene).

Figure 5:
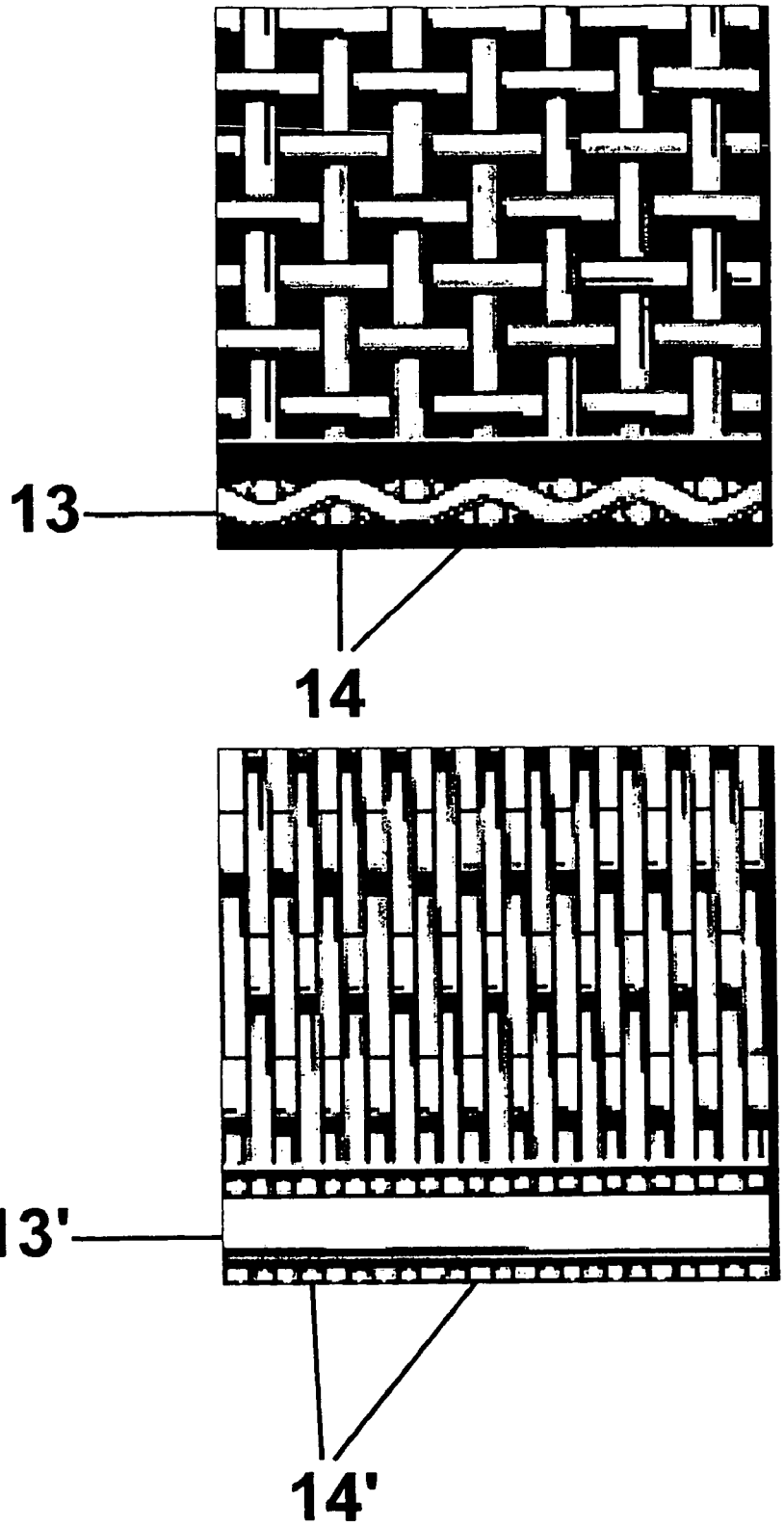
FIG. 5 shows the geometric parameters of two types of fabric that can be alternatively used for the construction of the diaphragm of FIG. 4.

In some cases, the fact that the perforations of the foraminous or porous region (12) of the diaphragm (11) are smaller than the tiniest beads fed in the cell, is not really sufficient to prevent a certain amount of metal from passing to the anodic compartment and dissolving therein. This is normally due to the fact that some tiny beads may stick in correspondence of the perforations and, due to the potential gradient, partially dissolve on one side while growing on the opposed side. Sometimes a spherical bead may even reshape in acicular form by means of this mechanism, until it is thin enough to pass to the anode side dissolving therein. In other cases, the friction of the falling bed is so high that the particles may experience some grinding effect. At least in the case of copper electrowinning, these phenomena are frequently experienced. It is therefore convenient to provide the insulating diaphragm (11) with particularly tortuous paths that prevent the easy escape of reshaped particles, without hindering too much the electrolyte circulation. For this purpose, fabrics, and particularly woven ones, are best suited. Woven polyester meets particularly well the requirements of bead exclusion, resistance to friction, insulating properties and cost. Plain weaves are suited to this scope; plain weaves are characterised by having warp and weft wires of the same diameter, the weft wire alternately passing above or below each subsequent warp wire. This is illustrated in the top section of FIG. 5, where the weft wire is indicated as (13) and the warp wires as (14). In a preferred embodiment, however, the fabric for the diaphragm (11) is woven as a reverse Dutch weave, as shown in the bottom section of FIG. 5, wherein weft wires (13') have a greater diameter than warp wires (14'), giving rise thereby to a warp mesh count greater than the weft mesh count. In a preferred embodiment, the diameters of the weft and warp wires are however close, their ratio being not greater than 1.5. A particular preferred weft wire to warp wire diameter ratio is 5:4.

Another important parameter for the fabric is the ratio between the warp wire spacing (that is the mean distance between two adjacent warp wires) and the warp wire diameter, which must be preferably greater than 3.

The preferred thickness for a fabric-made diaphragm is comprised between 0.4 and 0.6 mm.

Figure 6:
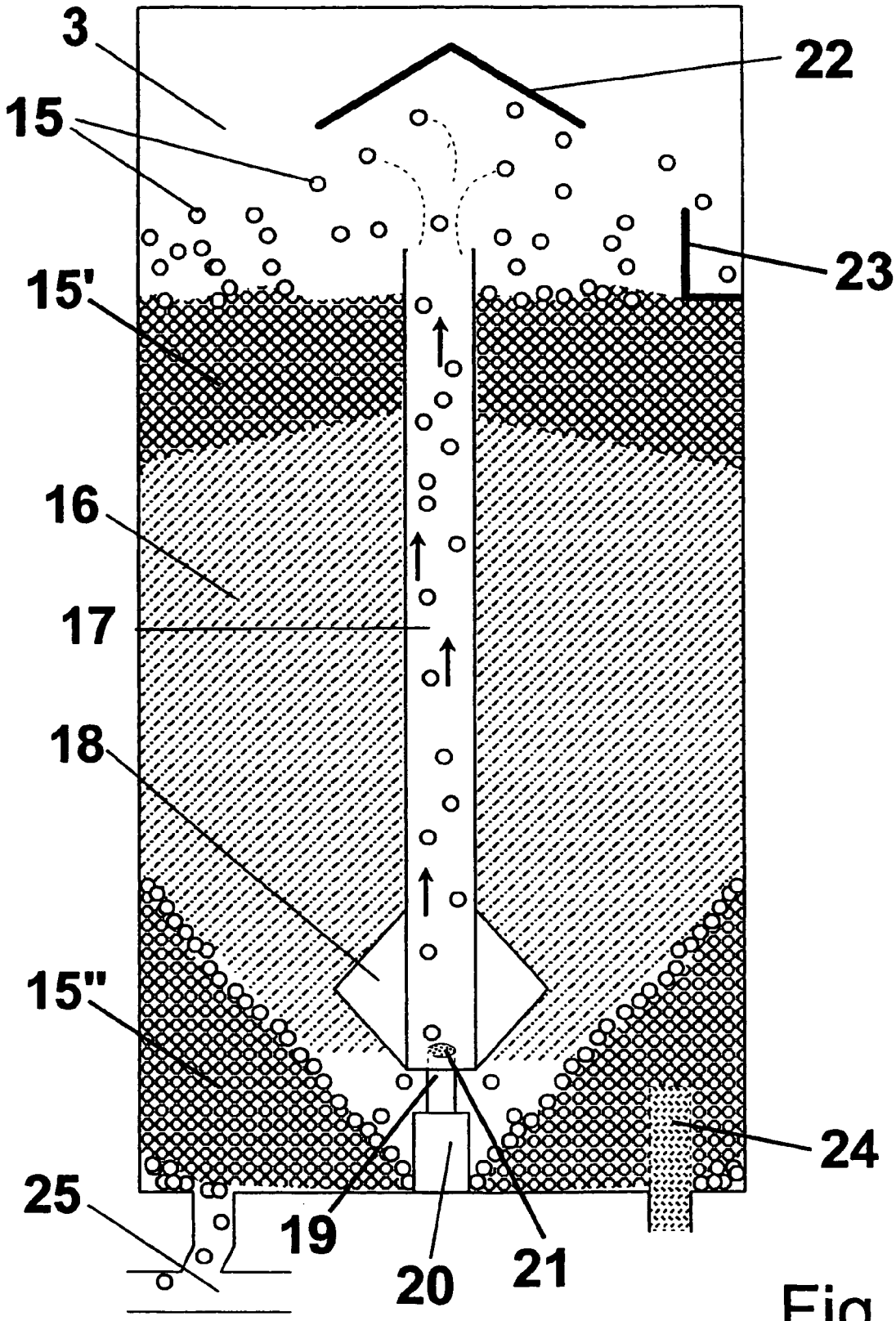
FIG. 6 is a front view of the cathodic compartment of the cell, comprising a draft tube establishing a spouted bed of metallic beads at the two sides thereof.

FIG. 6 shows the interior of the cathodic chamber, corresponding to the recess delimited by the peripheral frame (1) of the cathode shell (100) (see FIG. 1) and the cathodic plate (3). The cathodic chamber is the site wherein the spouted bed of metallic beads (15) is established by means of the electrolyte circulated through a draft tube (17). The draft tube (17) has preferably a rectangular section and fills the space between the cathodic plate (3) and the diaphragm (11), so that it can also act as a structural reinforcing element. Since in this case the draft tube experiences part of the clamping pressure of the cell, it will be preferably made with a corrosion resistant, mechanically robust material, such as stainless steel or titanium. The two major surfaces of the draft tube contacting the cathodic plate (3) and the diaphragm (11) should preferably be covered with an insulating material, such as a coating, for instance a PTFE or other polymeric coating. For instance, a PTFE coating can be applied by spraying and thermal setting. Insulating tapes such as foam tapes can also be advantageously used. In a preferred embodiment, not shown in the figure, the draft tube (17) is provided with an enlarged entry, for instance having a width equivalent to twice the width of the tube. In a more preferred embodiment, the bottom part of the draft tube (17) is provided with arrowhead-shaped elements (18), which largely improve the circulation in the spouted bed. The angle of the arrowheads with respect to the horizontal should be preferably comprised between 60 and 80°, with values close to 70° being preferred.

In the figure, it is shown how the beads (15) move upwardly in the draft tube (17), exit therefrom and form two annuli (15') on either side of the same, moving then downward in falling region (16). This happens when the draft tube (17) is placed in the centre of the cathodic chamber, but it might as well be possible to place the draft tube (17) near one side wall of the cathodic chamber, so that the movement of the beads (15) would trace a single annulus. In another embodiment, a plurality of parallel draft tubes (17) is provided in the cathodic chamber, so that a plurality of bead annuli (15') is formed. For the sake of simplicity, only the case of a single central draft tube will be discussed further. The electrolyte is supplied to the draft tube (17) by a nozzle (19), mounted on a support (20) connected to the pumping circuit (not shown). In one embodiment of the invention, the nozzle (19) has a porous top section (21) allowing the passage of the electrolyte but not of the beads (15). In this way, when scheduled or unforeseen shutdowns occur, the beads (15) are prevented from falling into the nozzle occluding the same, thereby hindering the restarting of the spouting action.

Other optional elements include a deflector (22) on top of the draft tube (17), which is used to limit the height of the spouted bed, a weir (23) connected to an over-flow system with a product collecting tank (not shown), providing for the withdrawal of a fraction of beads to allow the continuous operation of the cell, an electrolyte drain tube (24), provided with a filter element allowing the discharge of the electrolyte while preventing the concurrent discharge of beads, and a bead drain device (25) provided with a drainage tube and a Tee-shaped separation element, allowing the discharge of metal beads upon feeding electrolyte in the horizontal leg.

The over-flow system downstream of the weir (23) optionally comprises a tank with a cone shaped bottom where beads are collected, and means for withdrawing the beads from the tank bottom, as will be obvious for one skilled in the art. An electrolyte over-flow system, not shown, is also normally provided as obvious to one skilled in the art.

The lower corners of the cell could optionally be provided with triangle members, for instance plastic cones as known in the art, to facilitate the natural circulation of the beads. It has been found however that in the absence of such cones, beads tend to collect in the lower corner regions of the cell of the invention giving rise to self-forming moving cones of beads (15"), that in stationary conditions can act as efficiently as artificial cones. The natural formation of the cones is assisted by the correct dimensioning of the arrowhead shaped elements (18), and has the great advantage that cones can naturally reform changing their shape every time that the flow-rate is varied for any reason. The self-formation of moving cones of beads filling the lower corners of the cathode shell meanwhile allows the natural formation of bead flow channels into the vertical gap below the base of the draft tube.

The following two figures show alternative, preferred embodiments of some elements illustrated in FIG. 6.

Figure 7:
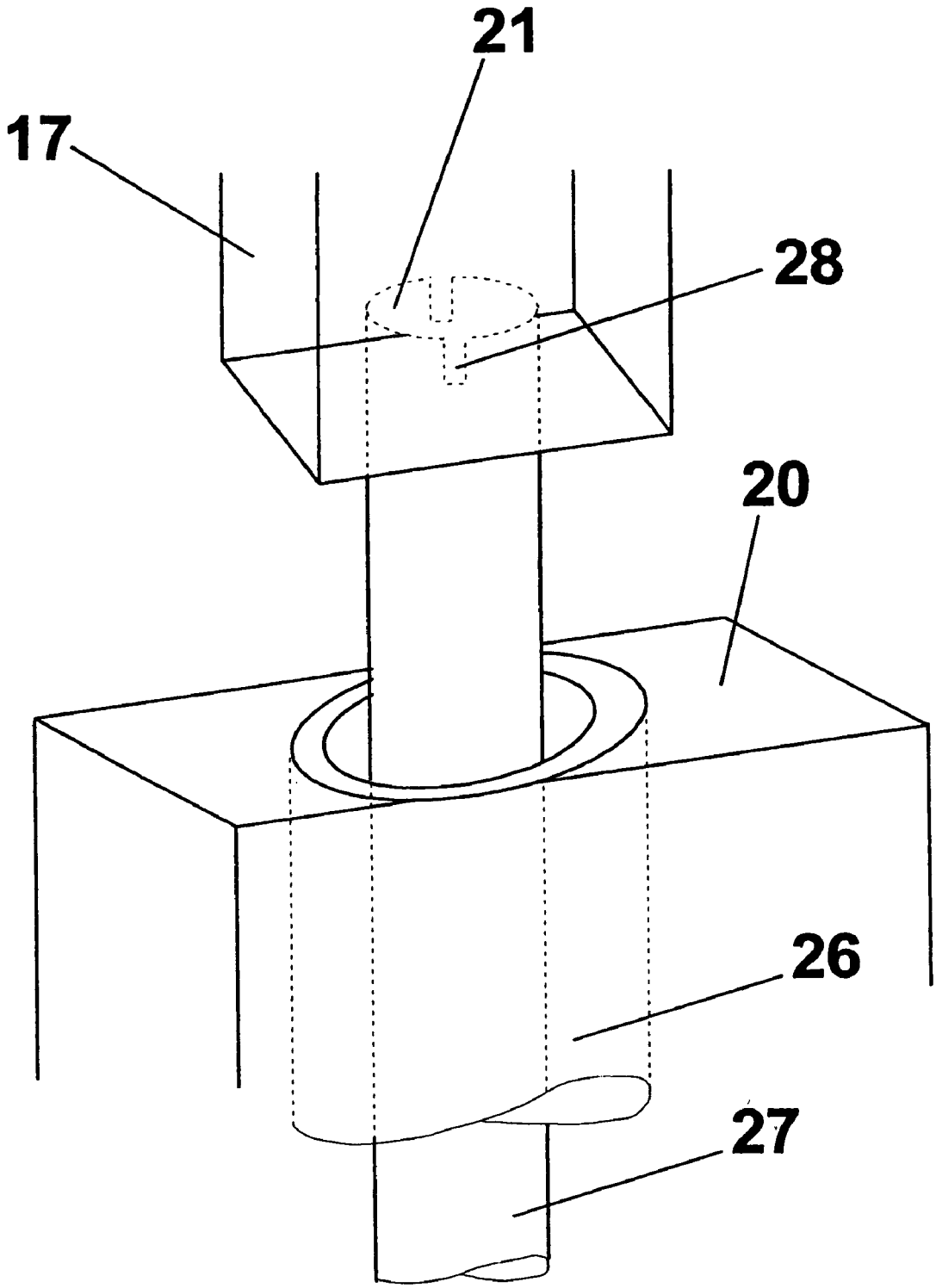
FIG. 7 is a sketch of a double nozzle for feeding the draft tube of the cell according to a particularly preferred embodiment of the invention.

FIG. 7 in particular shows a preferred embodiment of the nozzle (19), which in this case is designed as a double nozzle, comprising an inner portion defined by an inner duct (27) extending near the entrance of the draft tube (17), and an outer portion delimited by an outer duct (26) located at the base of the cell. In FIG. 7, the inner duct (27) extends within the draft tube (17), but it can as well barely reach the height of the draft tube bottom or even rest below the same. The outer duct (26) is shown as entering the support element (20), but it can be connected to the bottom of the cell according to several different arrangements as apparent to one skilled in the art.

Figure 8:
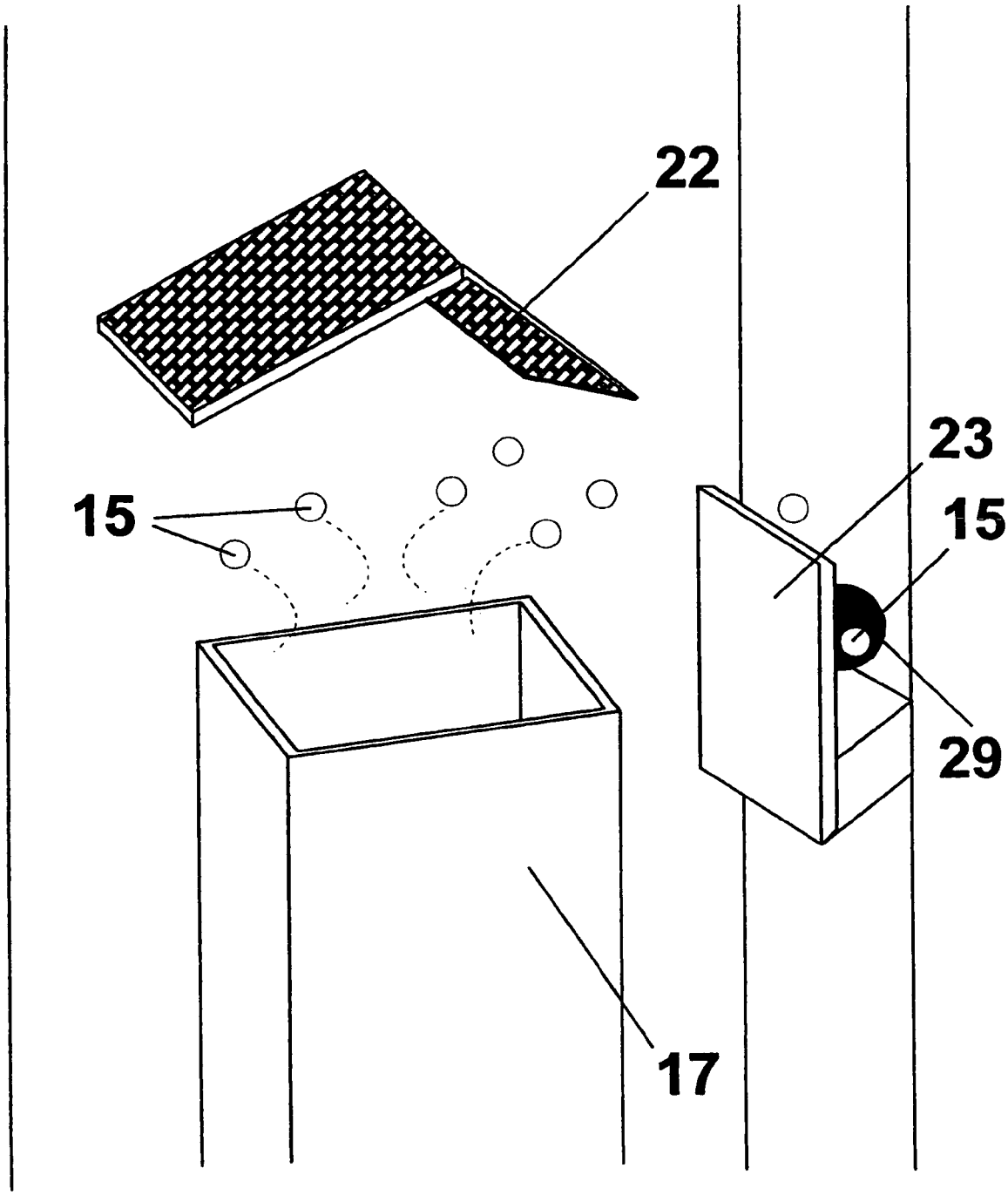
FIG. 8 is an enlargement of the top region of the draft tube shown in FIG. 6, including a deflector for controlling the height of the spouted bed and an element of the over-flow system, according to a preferred embodiment of the invention.

In FIG. 8 it is shown how the deflector (22) on top of the draft tube (17) can advantageously be a rooftop-shaped element, but other shapes are possible. In a preferred embodiment, the rooftop-shaped deflector (22) is provided with holes hindering the passage of the beads, but allowing the free passage of electrolyte, thereby interfering much less with the electrolyte circulation. FIG. 8 also shows the weir (23) with the relevant hole (29) at the entrance of the bead over-flow system.

Figure 9:
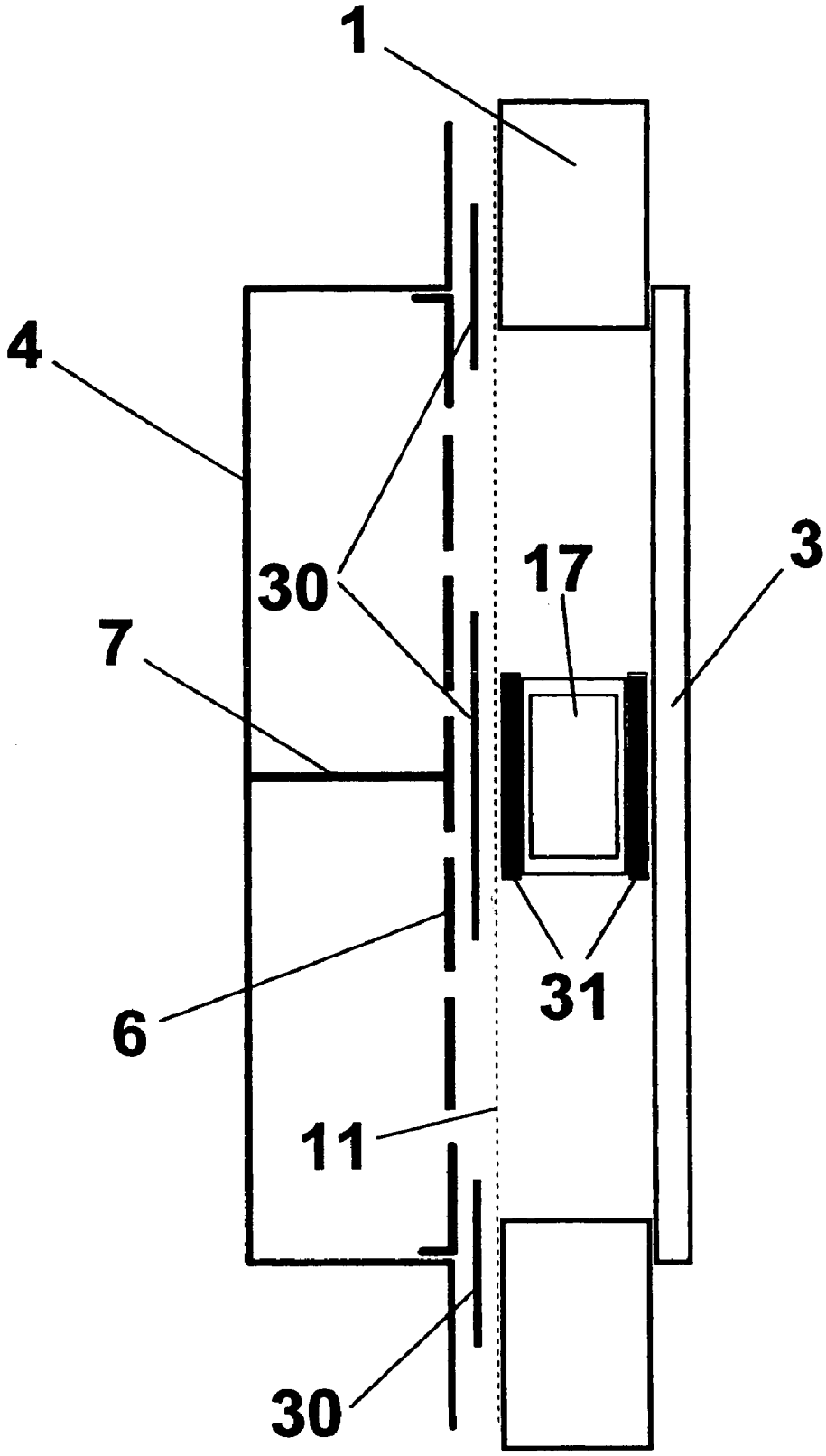
FIG. 9 is a top section of the cell showing insulating elements for the draft tube and the diaphragm according to a preferred embodiment of the invention.

FIG. 9 is a top section of the cell, corresponding to an arbitrary height within the spouted bed region. The cathode shell, delimited by the peripheral frame (1) and the cathodic plate (3), is filled in the central portion thereof by the draft tube (17), provided with insulating elements (31) such as coatings or foam tapes; in the anode shell, the anodic sheet (4) and the anode (6) are connected by means of conductive protrusions (7), only one or which is shown for the sake of simplicity. The two shells are divided by the diaphragm (11), optionally provided with an insulating protective mask (30) in correspondence of the outer edges of the anode (6) and of the vertical edges of the draft tube (17).

Figure 10:
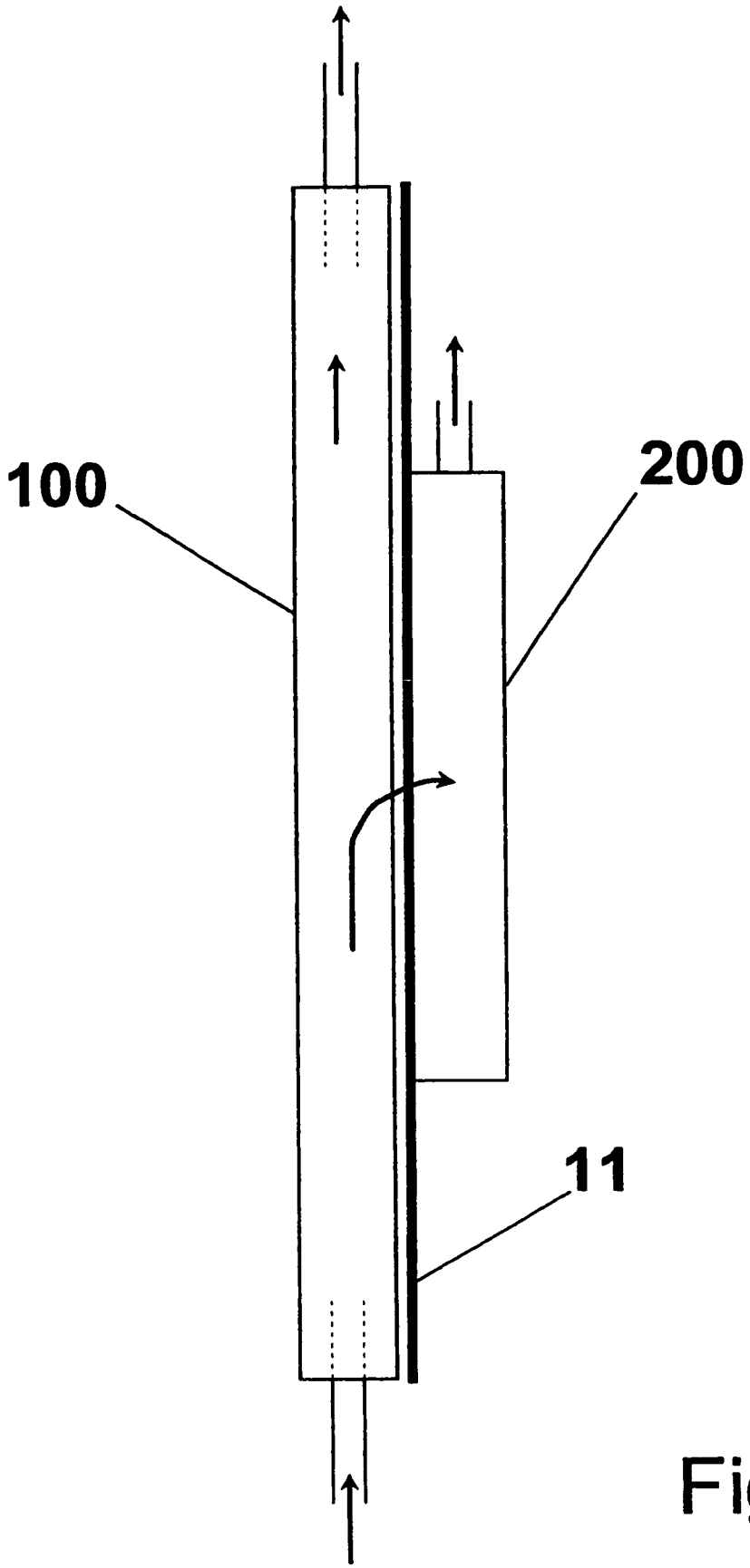
FIG. 10 is a scheme of the electrolyte circulation of the cell of the invention.

FIG. 10 is a side view of the cell of the invention illustrating the circulation of the electrolyte. The metal ion bearing electrolyte is fed in the bottom part of the cathode shell (100) through the nozzle and the draft tube (not shown), and a stream thereof enters the anode shell (200) in correspondence of the foraminous or porous region of the diaphragm (11) while most of it is used to establish the spouted bed within the cathode shell (100). The electrolyte is then discharged in the upper part of both shells and recirculated.

The invention can be practised, according to a less preferred embodiment, also with separate anodic and cathodic circulation in an array of stacked elements wherein the anodic plate of each cell, with the obvious exception of the terminal one, is put in contact with the cathodic plate of the adjacent cell. Preferably, each single cell element is constructed, by bolting or otherwise fastening each anode shell with the correspondent cathode shell, prior to stacking the elements. Preferably, the single cell elements are stacked interposing contact strips therebetween. The contact strips are preferably welded to the anodic plates. In the case of separate anodic and cathodic circulation, the cell elements may not include a semi-permeable diaphragm, an ion-exchange medium such as an ion-exchange membrane being sufficient. In this case, one still takes advantage of the cell lamination in terms of productivity per unit volume and per unit area of plant installation; this embodiment is however less preferred as a continuous process becomes more cumbersome to establish with separate anolyte and catholyte, each requiring ion concentration monitoring and restoring.

The above description shall not be understood as limiting the invention, which may be practised according to different embodiments without departing from the scopes thereof, and whose extent is solely defined by the appended claims.

In the description and claims of the present application, the word "comprise" and its variation such as "comprising" and "comprises" are not intended to exclude the presence of other elements or additional components.

The invention claimed is:

1. A cell element of a laminated cell array for the electrowinning of metal from metal ion solutions, comprising an anode shell and a cathode shell separated by an insulating diaphragm, the anode shell delimited by an anodic plate provided with at least one conductive protrusion for transmitting direct electric current to an anode, the cathode shell delimited by a cathodic plate provided with at least one draft tube capable of establishing a spouted bed of metallic beads, said diaphragm being provided with perforations in correspondence of said spouted bed of metallic beads allowing the free circulation of the electrolyte while hindering the passage of said metallic beads from the cathode compartment to the anode compartment, said at least one draft tube comprises a base provided with a double nozzle for feeding the electrolyte, thereby generating a motion capable of establishing said spouted bed of metallic beads and comprising an outer portion located at the base of the cell and an inner portion extending within or near the entrance of said at least one draft tube.

2. The cell element of claim 1 wherein said at least one conducting protrusion is shaped as a rib.

3. The cell element of claim 2 wherein said ribs have a first major surface whereto said anode is secured, and a second major surface provided with a contact strip, said contact strip being welded to said anodic plate.

4. The cell element of claim 2 wherein said anode shell further comprises rib-shaped spacers.

5. The cell element of claim 1 wherein said cathode shell is constructed from an array of bars.

6. The cell element of claim 5 wherein said bars are rectangular-shaped.

7. The cell element of claim 1 wherein said cathode shell comprises at least one window for inspection.

8. The cell element of claim 1 wherein said anode shell and said cathode shell comprise peripheral flat regions such as frames or flanges for fastening said anode shell to said cathode shell.

9. The cell element of claim 1 wherein said anode shell is made of titanium or an alloy thereof, and said cathode shell is made of stainless steel, nickel or titanium.

10. The cell element of claim 9 wherein said anode is a foraminous titanium structure coated with noble metals or noble metal oxides on at least one surface thereof.

11. The cell element of claim 9 wherein said anode shell is put in contact with the cathode shell of the adjacent cell element in the cell array with at least one bimetallic strip interposed therebetween.

12. The cell element of claim 11 wherein said at least one bimetallic strip is welded to at least one of said cathode shell and said anode shell.

13. The cell element of claim 12 wherein said at least one bimetallic strip is welded to said anode shell in correspondence of said at least one conducting protrusion.

14. The cell element of claim 13 wherein said at least one bimetallic strip and said at least one conducting protrusion are welded to said anode shell in a single step.

15. The cell element of claim 1 wherein said insulating diaphragm forms a full face gasket contributing to the hydraulic seal between said anode shell and said cathode shell at least in the peripheral portion thereof.

16. The cell element of claim 15 wherein said insulting diaphragm is provided with an additional insulating mask in correspondence of the regions contacting the outer edges of said anode and/or the vertical edges of said at least one draft tube.

17. The cell element of claim 1 wherein said insulating diaphragm is made of a woven fabric.

18. The cell element of claim 17 wherein said fabric is woven as a plain or as a reverse Dutch weave.

19. The cell element of claim 18 wherein said fabric has a ratio of weft wire to warp wire diameter comprised between 1.15 and 1.5.

20. The cell element of claim 19 wherein said fabric has a ratio of weft wire to warp wire diameter of about 5:4.

21. The cell element of claim 17 wherein the ratio of warp wire spacing to warp wire diameter is greater than 3.

22. The cell element of claim 17 wherein said woven fabric has a thickness comprised between 0.4 and 0.6 mm.

23. The cell element of claim 17 wherein said fabric is a polyester fabric.

24. The cell element of claim 10 wherein said insulating diaphragm is obtained by applying an insulating coating to the surface of said foraminous titanium anode opposed to said at least one surface coated with noble metals or noble metal oxides.

25. The cell element of claim 24 wherein said insulating coating is a ceramic coating.

26. The cell element of claim 25 wherein said ceramic coating is selected from the group consisting of valve metal oxides and silicon carbide.

27. The cell element of claim 26 wherein said ceramic coating is applied by plasma spraying.

28. The cell element of claim 24 wherein said insulating coating comprises a fluorinated polymeric material.

29. The cell element of claim 1 wherein said at least one draft tube is a rectangular-shaped tube.

30. The cell element of claim 29 wherein said rectangular-shape tube is made of a corrosion of resistant metal, preferably stainless steel or titanium.

31. The cell element of claim 30 wherein said metallic rectangular-shaped tube is provided with an insulating outer coating and/or with foam tape at least on the two major surfaces thereof parallel to said anodic plate and said cathodic plate.

32. The cell element of claim 29 wherein the depth of said rectangular shaped tube is equivalent to the distance between said cathodic plate delimiting said cathode shell and said diaphragm.

33. The cell element of claim 29 wherein the bottom of said at least one draft tube is provided with an enlarged entry with respect to the tube width.

34. The cell element of claim 29 wherein said at least one draft tube is provided with arrowhead shaped elements located in its lower part, the angle thereof with the horizontal being comprised between 60 and 80° and preferably equivalent to about 70°.

35. The cell element of claim 1 wherein said inner portion of the double nozzle is provided with perforations allowing the passage of electrolyte and hindering the passage of said metallic beads.

36. The cell element of claim 1 further comprising at least one deflector placed over the top of said at least one draft tube suitable for controlling the height of said spouted bed.

37. The cell element of claim 36 wherein said at least one deflector is generally rooftop-shaped.

38. The cell element of claim 36 wherein said at least one deflector is provided with holes allowing the free passage of electrolyte and hindering the passage of said metallic beads.

39. The cell element of claim 1 further provided with a bead over-flow system comprising at least one weir placed at an adjacent height to the top of said at least one draft tube and a tank for collecting the over-flowed beads.

40. The cell element of claim 39 wherein said tank is provided with means for discharging said over-flowed beads from the bottom.

41. The cell element of claim 39 wherein said tank has a cone-shaped bottom.

42. The cell element of claim 1 further comprising an electrolyte drain tube provided with a filter element allowing the discharge of the electrolyte from the cell while preventing the discharge of said metallic beads.

43. The cell element of claim 1 further comprising a bead drain device for discharging said metal beads therefrom provided with a drainage tube and a Tee-shaped separation element fed with electrolyte in the horizontal leg thereof.

44. A method for the electrowinning of a metal comprising feeding metallic beads in the cathodic compartment of a cell element of claim 1, putting said beads in electrical contact with said cathodic plate, and engaging said beads subjected to a cathodic potential in a spouted bed under the action of a metal ion bearing electrolyte supplied through said at least one draft tube.

45. The method of claim 44 wherein said spouted bed is formed by at least one bead filled generally rectangular-shaped annulus disposed on one side of said at least one draft tube.

46. The method of claim 44 wherein said spouted bed is formed by two bead filled generally rectangular-shaped annuli disposed on the opposite sides of said at least one draft tube.

47. The method of claim 45 wherein said two bead filled rectangular-shaped annuli allow the self-formation of moving cones of beads filling the lower corners of said cathode shell and allowing the natural formation of bead flow channels into the vertical gap below the base of said at least one draft tube.

48. The method of claim 44 wherein said metal to be electrowon is selected from the group consisting of copper, tin, manganese, zinc, nickel, chromium and cobalt.

* * * * *